US005242308A

United States Patent [19]

Estrada

[11] Patent Number: 5,242,308

[45] **Date of Patent: * Sep. 7, 1993**

[54] REUSABLE PINATA GAME HAVING RELEASABLY LATCHED CLOSURE

[76] Inventor: Luis I. Estrada, 235 SW. Le Jeune Rd., Miami, Fla. 33134

[ * ] Notice: The portion of the term of this patent subsequent to May 23, 2006 has been disclaimed.

[21] Appl. No.: 768,188

[22] PCT Filed: Feb. 10, 1989

[86] PCT No.: PCT/US89/00562

§ 371 Date: Oct. 9, 1991

§ 102(e) Date: Oct. 9, 1991

[51] Int. Cl.[5] ..... G09B 25/00

[52] U.S. Cl. ..... 434/365; 446/5

[58] Field of Search ..... 446/5, 4, 475, 487; 434/259, 365; 273/DIG. 30; 119/56.1

[56] References Cited

U.S. PATENT DOCUMENTS

| | | | |
|---|---|---|---|
| 729,675 | 6/1903 | Sarsfield | 119/56.1 X |
| 1,103,369 | 7/1914 | Montessori | 434/259 X |
| 2,659,163 | 11/1953 | Albee | 434/259 X |
| 4,015,364 | 4/1977 | Oquita | 446/5 |
| 4,253,266 | 3/1981 | Bajo | 446/5 |
| 4,349,197 | 9/1982 | Livick | 434/259 X |
| 4,787,872 | 11/1988 | Bajo | 446/5 |
| 4,832,337 | 5/1989 | Estrada | 434/259 X |

*Primary Examiner*—John J. Wilson
*Assistant Examiner*—Jeffrey A. Smith
*Attorney, Agent, or Firm*—Jesus Sanchelima

[57] ABSTRACT

A reusable piñata (10) for dispensing tokens or objects (40) that have a predetermined configuration to fit cavities (52) in boards (50). The objects are dispensed when strings (36) are pulled that open the closure members (32) and (32') that are pivotally mounted to the bottom of a hollow container (30). The container (30) is suspended from a stand assembly (20) that includes a base (22), an upwardly extending pole member (24) and an arm member (26) that is substantially perpendicular to the pole member (24). A timer (60) is mounted to the pole member (24).

4 Claims, 6 Drawing Sheets

REUSABLE PINATA GAME HAVING RELEASABLY LATCHED CLOSURE

TECHNICAL FIELD

The present invention relates to piñata games, and more particularly, to those piñata games that are reusable.

BACKGROUND ART

Piñata designs usually include a container that is filled with candy bars and toys. The Mexican piñatas are typically hit by one of the children playing the game and the Cuban piñata involve the pulling of ribbons to make an opening through the bottom of a container. Both of these piñata designs involve the destruction of the piñata.

SUMMARY OF THE INVENTION

It is one of the main objects of the present invention to provide a reusable piñiata game that can be utilized several times.

It is another object of this present invention to provide such a piñata game that is educational requiring the participating children to recognize the shapes of tokens dropped by the piñata and encourges them to do this within given time parameters.

It is yet another object of this present invention to provide such a game that is inexpensive to manufacture and reuse while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
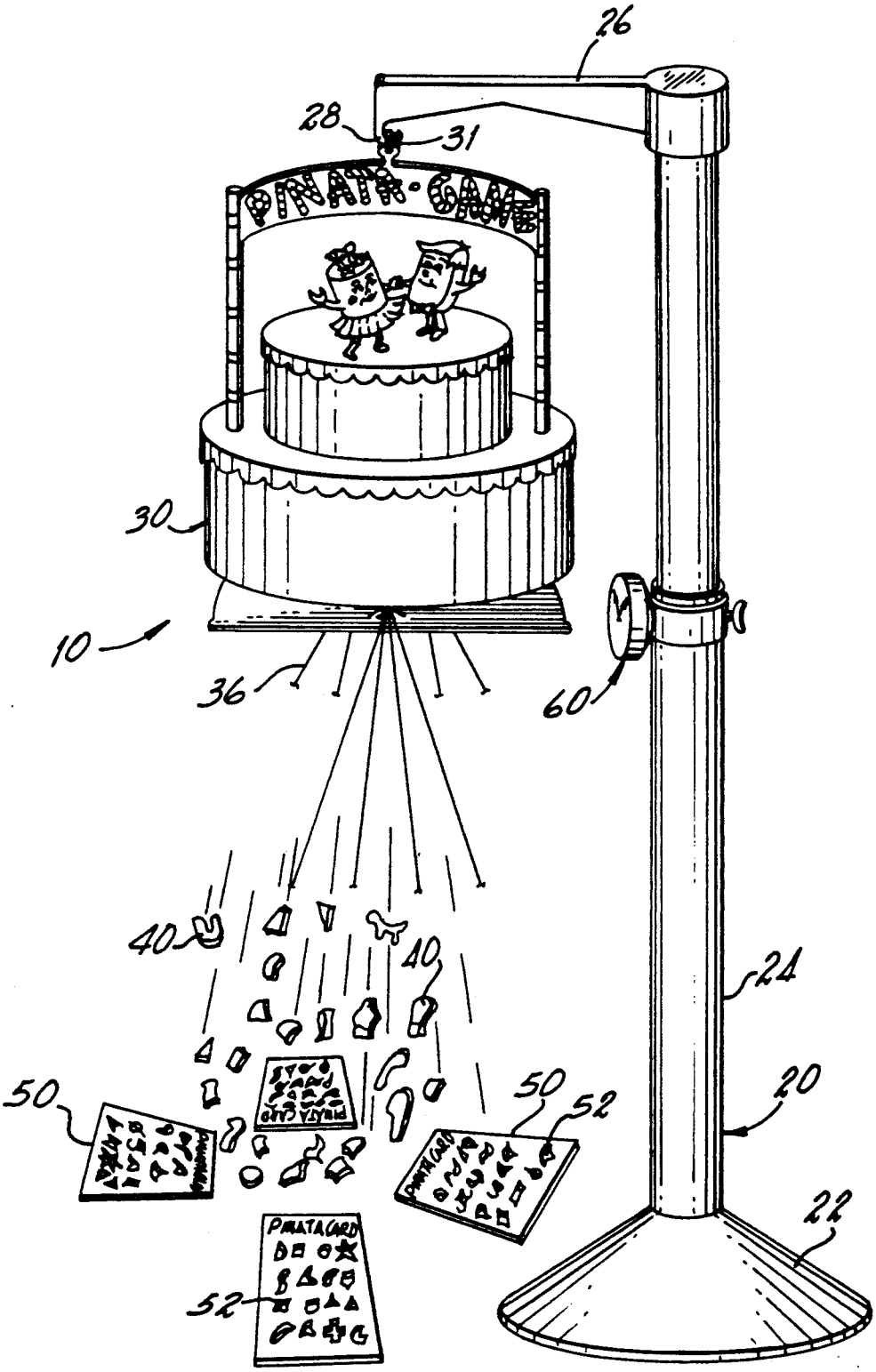
FIG. 1 represents a view in perspective of the present invention after the strings are pulled showing the different tokens being dropped by the container portion of the pinata.

Referring now to FIG. 1, where the present invention is generally referred to with numeral 10, it can be observed that it basically includes adjustable height stand assembly 20, hollow container member 30, game objects 40, game boards 50 and timer 60 mounted preferably on assembly 20.

Figure 5:
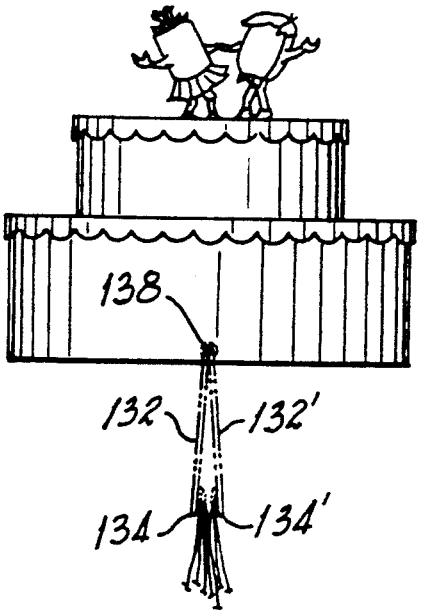
FIG. 5 shows an alternate embodiment incorporating the present invention showing the centrally hinged bottom sections in an open position.
Figure 6:
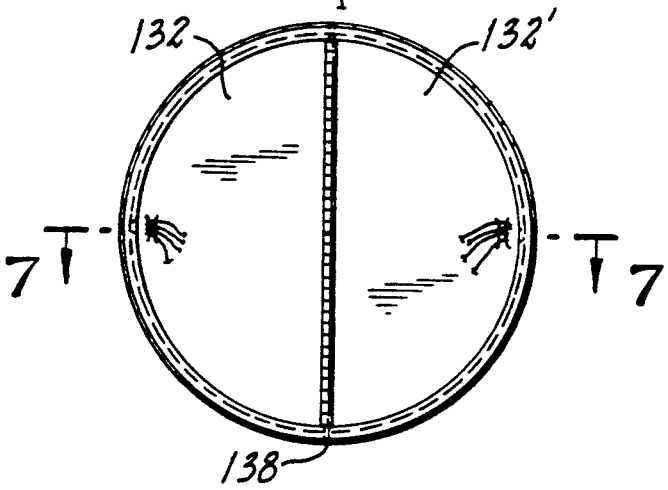
FIG. 6 is a bottom view of the alternate embodiment of FIG. 5 in closed position.
Figure 7:
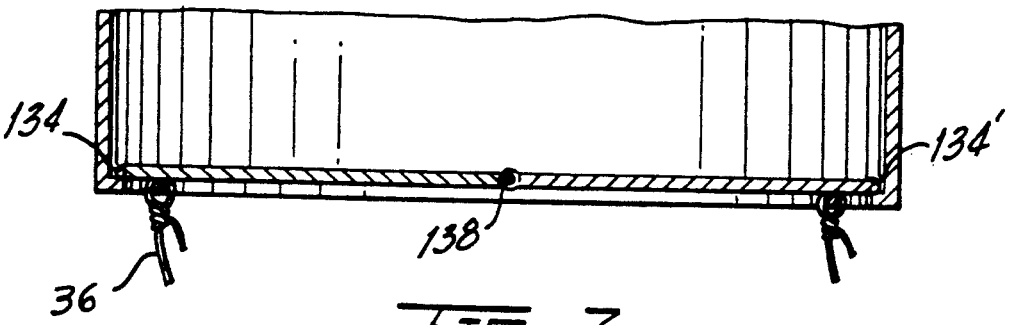
FIG. 7 is a representation of a cross-sectional view taken along line 7—7 in FIG. 6.
Figure 11:
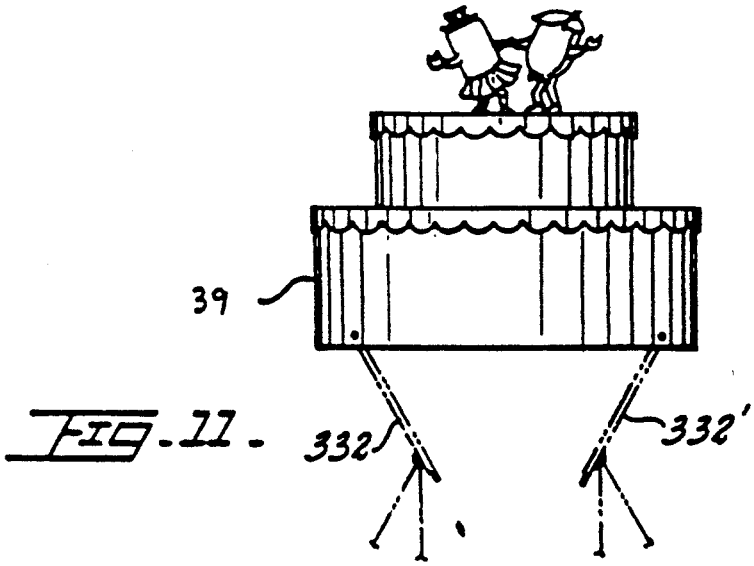
FIG. 11 shows a third embodiment of the present invention with closure members of semicircular shape similar to those of FIGS. 2; 3 and 4 having complementary edge walls at the straight edges.
Figure 12:
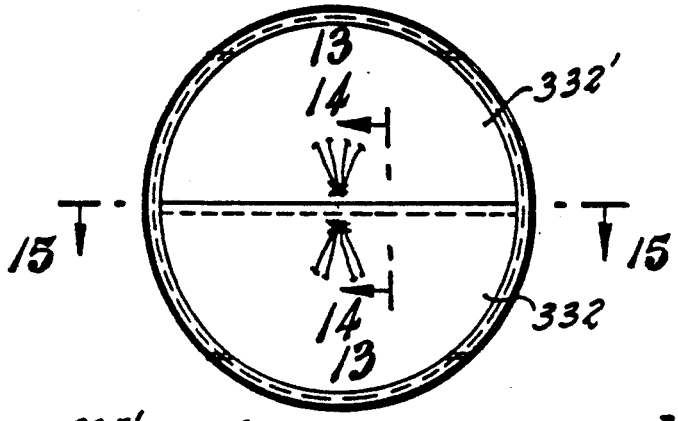
FIG. 12 shows a bottom view of the third embodiment shown in FIG. 11, in the closed position.

Stand assembly 20 comprises base member 22 having a sufficiently large footprint to provide the necessary stability to the structure which extends upwardly and horizontally with pole member 24 and arm member 26. Hook member 28 is located preferably at the outer end of arm member 26 to provide suitable means for supporting container 30 through loop 31. Container 30 is hollow and it is suspended from the end of arm 26. The outer surface of container 30 is designed with an attractive ornamental shape and look and it is made out of a washable material, such as, plastic or equivalent. Container 30 includes an opening in the bottom where two closure members 32 and 32' are pivotally mounted off-center, as best shown in the preferred embodiment in FIGS. 2 and 3 and in the third alternate embodiment in FIGS. 11 and 12. The first alternate embodiment is shown in FIGS. 5 and 6 and it discloses two closure members 132 and 132' that are hingedly mounted at the flat side of a semicircle. The second alternate embodiment consists of a unitary closure member 232 that is centrally hingedly mounted so that it pivots over its centerline, as best shown in FIGS. 8 and 9.

Figure 2:
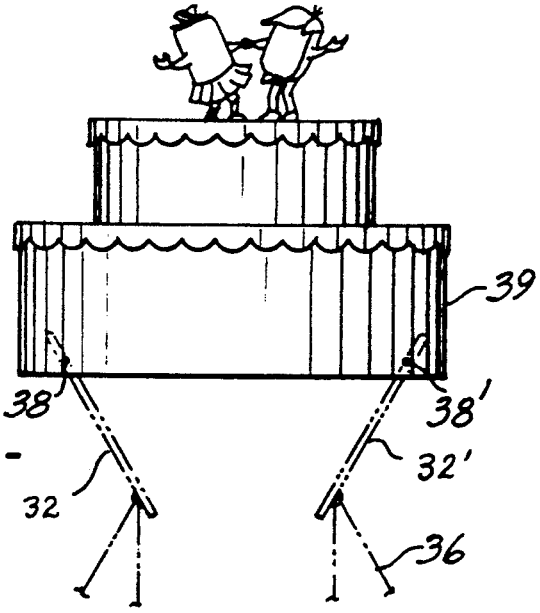
FIG. 2 shows an elevational view of the container.
Figure 3:
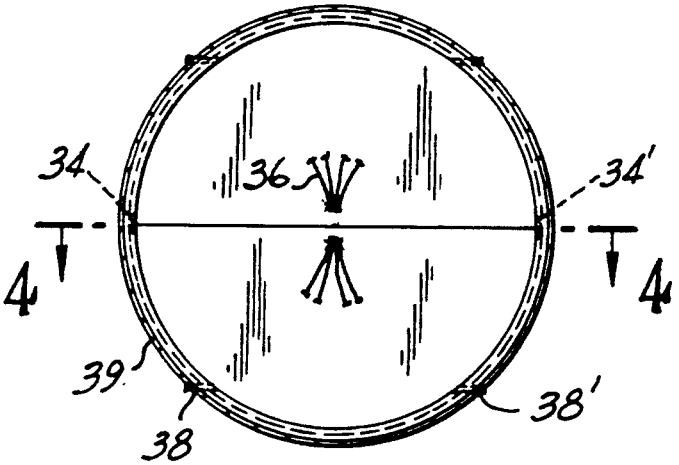
FIG. 3 illustrates a bottom view of the preferred embodiment for the container of the pinata.
Figure 4:
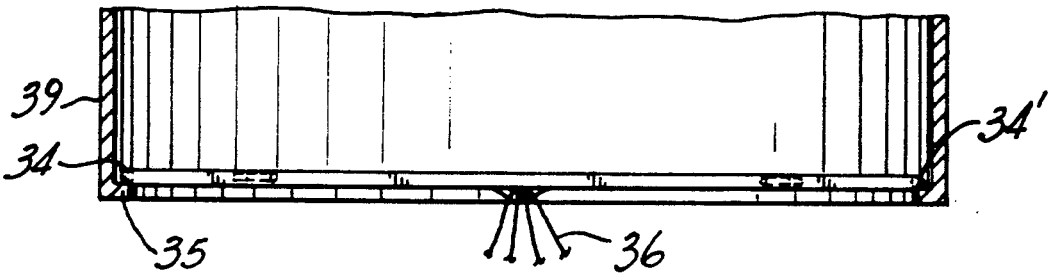
FIG. 4 is a representation of a partial view taken along line 4—4 in FIG. 3.

Closure members 32 and 32'; 132 and 132'; 232; 332 and 332' are releasably latched in the closed position when in the horizontal plane as shown in the drawings. Latching tab members 34 and 34', 134 and 134'; 234 in the preferred, first and second alternate embodiments can be implemented in a number of ways including a resilient termination that is capable of holding the closure members in the horizontal position and, upon the exertion of a predetermined downwardly pulling force through strings 36. Simple means for releasably holding closure members 32 and 32'; 132 and 132' and 234 in a horizontal plane is thereby provided. Latching tab members 34 and 34' rest on inwardly extending flange 35. Closure members 32 and 32', as well as integrally built latching tab members 34 and 34', are made of a resilient material that allows for certain deformation when strings 36 are pulled thereby exerting a downward force on closure members 32 and 32'. The deformation is sufficient to cause a deflection on closure members 32 and 32' allowing tab members 34 and 34' to slip down. Closure members 32 and 32' are pivotally mounted to lateral wall 39 of container 30 through pins 38 and 38', as best seen in FIGS. 2; 3 and 4.

First alternate embodiment works like the preferred embodiment with the exception of the manner in which closure members 132 and 132' are hingedly mounted and using only one pivoting point implemented with pin 138. The first alternate embodiment can be appreciated in FIGS. 5; 6 and 7.

Figure 8:
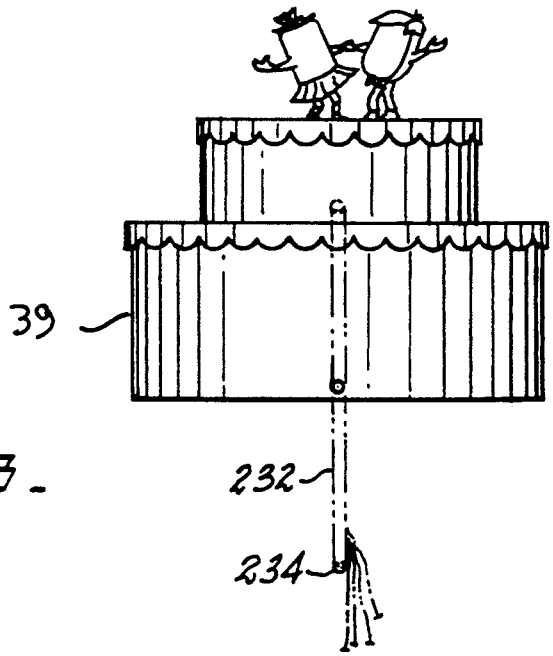
FIG. 8 illustrates a second embodiment of the present invention showing a centrally pivoted unitary closure member.
Figure 9:
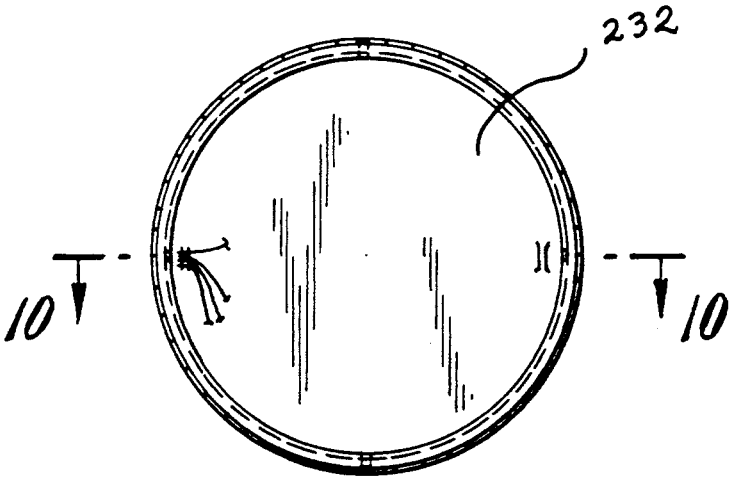
FIG. 9 shows a bottom view of the second embodiment shown in FIG. 8 with the bottom in the closed position.
Figure 10:
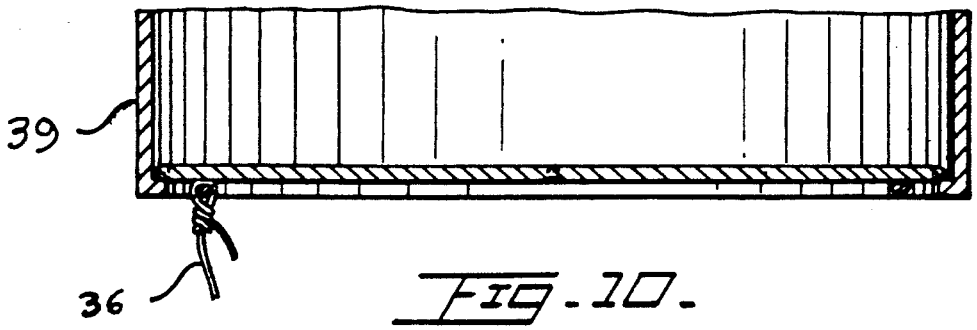
FIG. 10 is a representation of a cross-sectional view taken along line 10—10 in FIG. 9.
Figure 13:
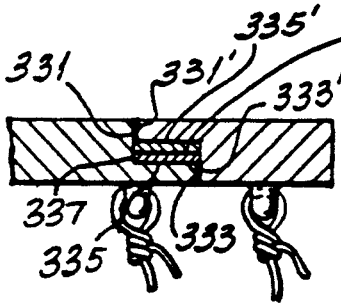
FIG. 13 shows a detail view of the straight edge of the semicircular closure members incorporating magnetic elements positioned on the horizontal walls.
Figure 14:
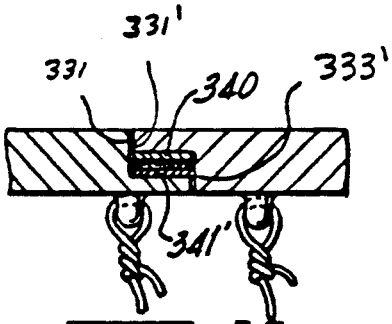
FIG. 14 shows a detail view of the straight edge of the semicircular closure members incorporating Velcro pads on the horizontal walls.
Figure 15:
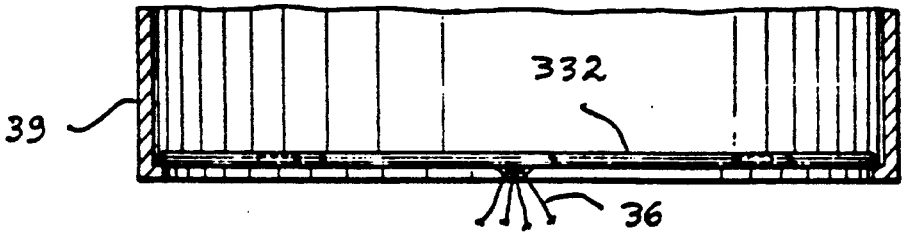
FIG. 15 is a cross-sectional view taken along line 15—15 in FIG. 12.

The second alternate embodiment uses only one closure member 232 that is centrally pivoted and releasably held in place by tab member 234, as seen in FIGS. 8; 9 and 10. The third alternate embodiment disclosed in the present application is similar to the preferred embodiment disclosed above except that instead of tab for releasably holding the closure members in place, The straight edge of semicircular closure members 332 and 332' have complementary vertical and horizontal walls 331; 331'; 333 333'; 335 and 335', as best seen in FIGS. 13 and 14. To keep these walls in locking abutment, flat magnetic members 336 and 337 with opposite poles facing each other may be used, as seen in FIG. 13. Also, pressure sensitive pads Velcro pads 340 and 341' can be used to keep closure members 332 and 332' in a horizontal plane.

Figure 16:
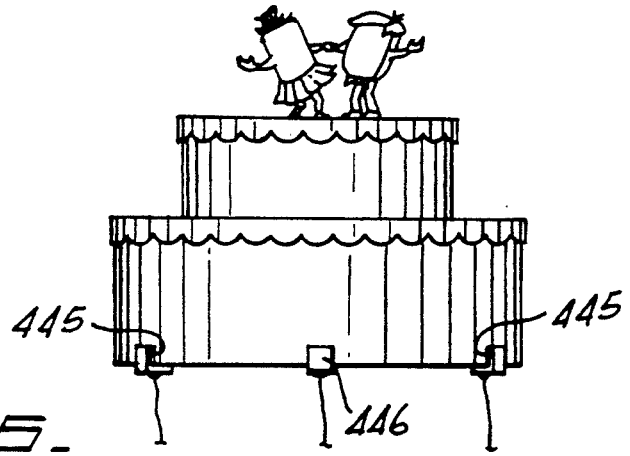
FIG. 16 illustrates a fourth embodiment of the present invention showing a unitary closure member held in place by several Velcro straps and cooperatively positioned pads.
Figure 17:
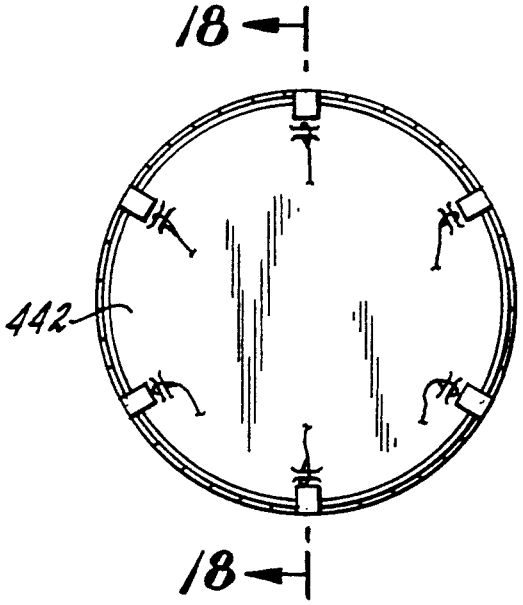
FIG. 17 shows a bottom view of the fourth alternate embodiment shown in FIG. 16.
Figure 18:
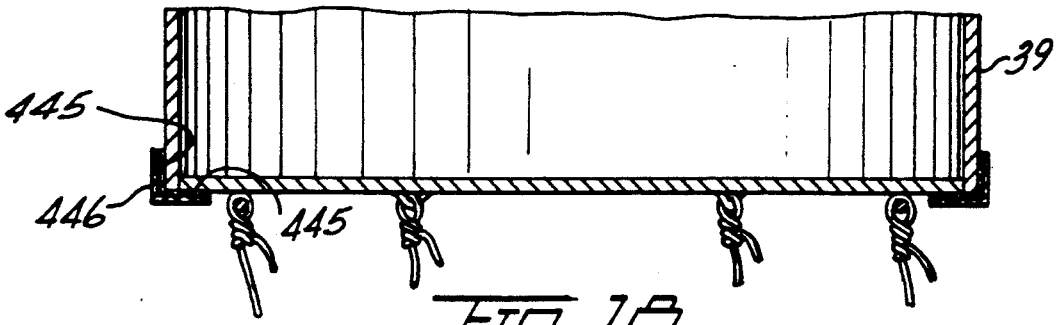
FIG. 18 is a cross-sectional view taken along line 18—18 in FIG. 17.

The fourth alternate embodiment, shown in FIGS. 16; 17 and 18, utilizes a unitary closure member 442. Member 442 is held in place by several pressure sensitive pads Velcro pads 445 that are mounted on the periphery of the outer face of closure member 442 and on the lower portion of lateral wall 39 and straps 446 of opposite type that mates with pads 445.

A number of tokens or objects 40, with a variety of shapes, are loaded into container 30. When they are dispensed, as the result of the children pulling strings 36, they fall so that they can be picked up by the players and matched with the cavities or apertures 52 in boards 50. A timer 60 is mounted to pole member 24, preferably, so that the players can be timed, if desired.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

It is apparent from the previous paragraphs that an improvement of the type for such piñata games is quite desirable for a reusable piñata game that can be utilized several times and that is educational requiring the participating children to recognize the shapes of tokens dropped by the piñiata and encourges them to do this within given time parameters.

What is claimed is:

1. An educational game for children comprising a) a stand;

b) a hollow container, including a bottom, is suspended from said stand;

c) an opening in the bottom of said hollow container;

d) a closure member pivotally mounted within said opening, said closure member being movable between a horizontal position closing said opening and a vertical position opening said opening;

e) means for releasably latching said closure member in its horizontal position closing said opening;

f) means for releasing said latching means to permit said closure member to pivot from its horizontal to its vertical position; and g) a plurality of strings attached on one end to said closure member and the other end being free so that the players may pull from said string members to release said closure member from its horizontal position.

2. The game set forth in claim 1 wherein said latching means includes a tab member outwardly extending from the periphery of said closure member and said container includes an inwardly extending flange that cooperates with said tab member to keep said closure member in the horizontal position.

3. The game set forth in claim 1 wherein said latching means includes a plurality of pressure sensitive pads of one type mounted adjacent to the periphery of said closure member and the lower edge of the lateral wall of said container and further including a corresponding plurality of pressure sensitive straps of the opposite mating type and of sufficient dimensions to cover substantially said pads.

4. The game set forth in claim 3 wherein said latching means includes a tab member outwardly extending from the periphery of said closure member and said container includes an inwardly extending flange that cooperates with said tab member to keep said closure member in the horizontal position.

* * * * *